US009437971B2

(12) United States Patent
Yang et al.

(10) Patent No.: US 9,437,971 B2
(45) Date of Patent: Sep. 6, 2016

(54) CONNECTOR WITH A LOCKING AND UNLOCKING MECHANISM

(71) Applicant: Teralux Technology Co., Ltd., Kunshan, Jiangsu Province (CN)

(72) Inventors: Hsin Chih Yang, Kunshan (CN); Le Yu, Kunshan (CN); Jin Hua Meng, Kunshan (CN)

(73) Assignee: Teralux Technology Co., Ltd., Kunshan (CN)

( * ) Notice: Subject to any disclaimer, the term of this patent is extended or adjusted under 35 U.S.C. 154(b) by 0 days.

(21) Appl. No.: 14/812,593

(22) Filed: Jul. 29, 2015

(65) Prior Publication Data

US 2016/0218463 A1 Jul. 28, 2016

(30) Foreign Application Priority Data

Jan. 23, 2015 (CN) ..... 2015 2 0046318 U

(51) Int. Cl.
*H01R 13/627* (2006.01)
*H01R 13/633* (2006.01)
*H01R 13/631* (2006.01)

(52) U.S. Cl.
CPC ..... *H01R 13/6275* (2013.01); *H01R 13/631* (2013.01); *H01R 13/6335* (2013.01)

(58) Field of Classification Search
CPC ..... H01R 13/6275
USPC ..... 439/352, 153
See application file for complete search history.

(56) References Cited

U.S. PATENT DOCUMENTS 8,475,197 B2 * 7/2013 Zerebilov ..... H01R 13/6275 439/352
8,858,095 B2 * 10/2014 Meng ..... G02B 6/4292 385/93
8,888,382 B2 * 11/2014 Meng ..... G02B 6/42 385/85
8,986,036 B2 * 3/2015 Lindkamp ..... G02B 6/4246 439/160
2010/0317218 A1 * 12/2010 Wu ..... H01R 13/6275 439/352
2012/0190223 A1 * 7/2012 Wu ..... H01R 13/633 439/152
2013/0077921 A1 * 3/2013 Meng ..... G02B 6/4292 385/93
2013/0183009 A1 * 7/2013 Meng ..... G02B 6/42 385/89
2013/0280932 A1 * 10/2013 Lindkamp ..... G02B 6/4246 439/152
2014/0193993 A1 * 7/2014 Meng ..... H01R 13/633 439/352
2014/0235091 A1 * 8/2014 Wang ..... H01R 13/6275 439/352

* cited by examiner

*Primary Examiner* — Abdullah Riyami
*Assistant Examiner* — Nader Alhawamdeh
(74) *Attorney, Agent, or Firm* — Roger D. Emerson; Emerson Thomson Bennett

(57) ABSTRACT

A connector with a locking and unlocking mechanism is disclosed. The connector includes a case, a spring member and an unlocking member. The case includes a guiding groove, a narrow groove, a protrusion, a vertical stop wall and a latching groove. The spring member and the unlocking member are mounted the case. The unlocking member includes a guiding arm, a latching plate and a bending end. A vertical portion of the unlocking member is inserted between the spring member and the case. The guiding arm extends into the corresponding guiding groove. The latching plate enters into the latching groove. The bending end enters into the narrow groove and covers the protrusion. When a pulling portion is pulled back, the vertical portion compresses the spring member, the latching plate slides back along the latching groove, and the bending end moves back along the protrusion.

10 Claims, 5 Drawing Sheets

CONNECTOR WITH A LOCKING AND UNLOCKING MECHANISM

BACKGROUND OF THE INVENTION

1. Field of the Invention

The present invention relates to a connector technology and more particularly to a connector with a locking and unlocking mechanism.

2. Description of the Prior Art

A QSFP (Quad Small Form-factor Pluggable) connector is a high density and high speed pluggable connector. Generally, the QSFP connector disposes a locking mechanism. When the QSFP connector is connected to a receptacle connector, the QSFP connector is firstly inserted into a shielding case and is fixed in the shielding case by the locking mechanism, thereby ensuring the connection safety between the QSFP connector and the receptacle connector. When needing to disconnect the QSFP connector from the receptacle connector, the QSFP connector is firstly detached from the shielding case by an unlocking mechanism, so the QSFP connector can be fast pulled out from the receptacle connector.

However, the connector is becoming smaller and smaller, and the intensive degree of the receptacle connector in an electronic equipment is gradually increased. Therefore, the mechanism attaching or detaching the QSFP connector from the shielding case becomes more complex, and the operation thereof also becomes more difficult.

Hence, it is necessary to provide a new connector to simplify the lock and unlocking mechanism and further simplify the operation thereof.

BRIEF SUMMARY OF THE INVENTION

An object of the present invention is to provide a connector with a locking and unlocking mechanism, which can be locked and unlocked and the locking and unlocking operation of which is extremely convenient and fast.

To achieve the above object or other objects of the present invention, the present invention adopts the following technical solution.

The present invention provides a connector with a locking and unlocking mechanism, comprising a case, a spring member and an unlocking member. The case includes an inserting portion located in the front thereof, a retaining portion located in the rear thereof, and two guiding grooves being symmetrically formed two opposite sides of the case. The retaining portion includes a top surface, a mounting surface lower than the top surface, and a shoulder connecting the mounting surface and the top surface. The case includes a narrow groove, which is located in front of each guiding groove and the width of which is less than that of the guiding groove, a protrusion located in the narrow groove, a vertical stop wall located between the guiding groove and the narrow groove, and a latching groove located in rear of the vertical stop wall. The spring member is mounted on the mounting surface and has at least one supporting foot facing the shoulder. The unlocking member includes a top wall, a vertical portion bent downward from a front side of the top wall, two symmetrical guiding arms respectively bent downward from two sides of the top wall and extending forward, and a pulling portion located in rear of the top wall. The unlocking member further includes a latching plate, which is formed in front of each of the two guiding arms and the width of which is larger than that of the guiding arm, and a bending end, which extends forward from a front edge of the latching plate and the width of which is less than that of the guiding arm. Wherein the top wall of the unlocking member covers the mounting surface, the vertical portion is inserted between the supporting foot and the shoulder, the supporting foot presses on the vertical portion, the guiding arm extends into the corresponding guiding groove, the latching plate enters into the latching groove, the bending end enters into the narrow groove and covers the protrusion, the length of the latching plate is less than that of the latching groove. When pulling the pulling portion backward, the vertical portion is moved backward and compresses the spring member, the guiding arm is moved backward along the guiding groove, the latching plate slides backward along the latching groove, and the bending end is moved backward along the protrusion.

In one embodiment, the case further includes a front block formed on the mounting face, a rear block formed on the mounting surface and an arc groove located between the front block and the rear block.

In one embodiment, the spring member has an arc section and two supporting feet, the arc section is mounted in the arc groove, and the two supporting feet are symmetrically formed on two ends of the arc section and extend out of the arc groove.

In one embodiment, the arc groove is V-shaped, two ends of the arc groove are extending toward the shoulder, and the width of each end of the arc groove is larger than the width of the middle of the arc groove; the arc section is V-shaped, and the two supporting feet are respectively bent from the two ends of the arc section and extend outward.

In one embodiment, the latching groove is formed on inner walls of the guiding groove and is communicated with the guiding groove, and the latching plate is inserted into the latching groove.

In one embodiment, each guiding groove includes a linear groove located in the rear of the guiding groove and a tilted groove located in the front of the guiding groove and tilted inward, the depth of the tilted groove is larger than that of the linear groove, the narrow groove is located in front of the tilted groove, and the latching groove is communicated with the tilted groove.

In one embodiment, each guiding arm has a linear arm located in the rear thereof and a tilted arm located in the front thereof and tilted inward, and the latching plate and the bending end are formed on a front end of the tilted arm.

In one embodiment, the bending end has a convex surface covering the protrusion and a concave surface being toward outside.

In one embodiment, the pulling portion is a pulling belt.

In one embodiment, the top surface of the retaining portion is higher than a top surface of the inserting portion, and the mounting surface and the top surface of the retaining portion are parallel each other.

In comparison with the prior art, the connector with a lock and unlock mechanism of the present invention can be efficiently locked in a shielding case by disposing the vertical stop wall on the case, can be efficiently unlocked by the bending end of the unlocking member, and can be restored to the initial state under the function of the spring member. It can be seen that the locking and unlocking way of the connector is very convenient and fast.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "top", "bottom", "front", "back", "left", "right", "top", "bottom" etc., are only used with reference to the orientation of the accompanying drawings. For example, the following description may refer to the orientation of FIG. 1. Therefore, the used directional terms are intended to illustrate, but not to limit, the present invention.

Please refer to FIGS. 1 to 4, a connector 1 with a locking and unlocking mechanism mainly comprises a case 10, a spring member 20 mounted on the case 10, and an unlocking member 30 mounted on the case 10.

Figure 2:
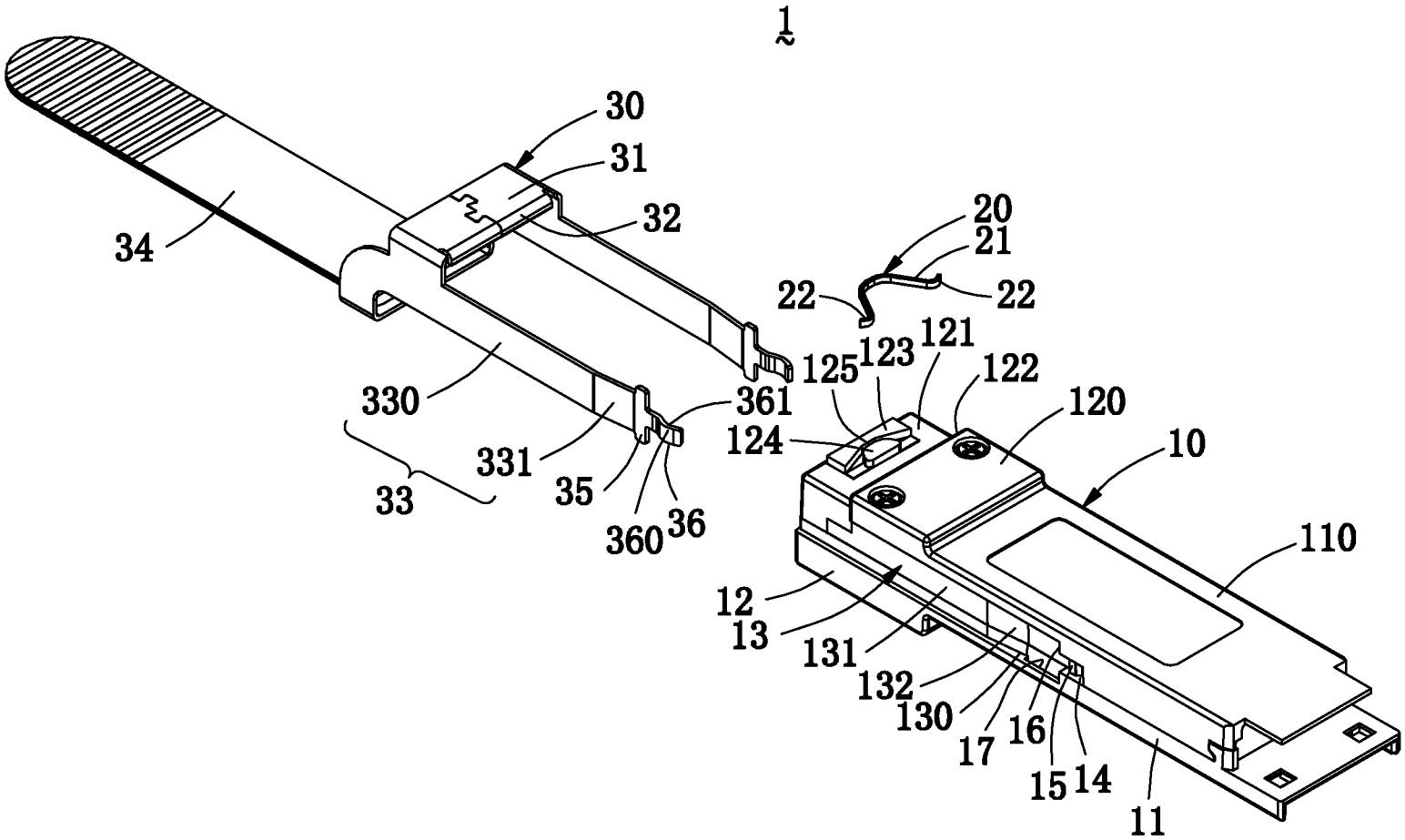
FIG. 2 is an exploded view of the connector with a locking and unlocking mechanism of the present invention, wherein an unlocking member and a spring member are removed from a case.

Referring to FIG. 2, the case 10 has an inserting portion 11 located in the front thereof and a retaining portion 12 located in the rear thereof. A top surface 120 of the retaining portion 12 is higher than a top surface 110 of the inserting portion 11. Please refer to FIG. 5, the inserting portion 11 of the case 10 can be inserted into a shielding case 9 for being connected with a receptacle connector (now shown), but the retaining portion 12 is exposed to the outside of the shielding case 9.

Referring to FIG. 2, the retaining portion 12 of the case 10 includes a mounting surface 121 being lower than the top surface 120 and being parallel to the top surface 120, a shoulder 122 connecting the mounting surface 121 and the top surface 120, a front block 123 formed on the mounting surface 121, a rear block 124 formed on the mounting surface 121, and an arc groove 125 formed between the front block 123 and the rear block 124. In the embodiment, the arc groove 125 is generally V-shaped. Two ends of the arc groove 125 are extending toward the shoulder 122, and the widths of the two ends of the arc groove 125 are larger than the width of the middle of the arc groove 125.

Referring to FIG. 2, the case 10 includes two guiding grooves 13 being symmetrically formed two opposite sides of the case 10 and extending along a length direction of the case 10. The case 10 further includes a narrow groove 14 located in front of each guiding groove 13, a protrusion 15 located in the narrow groove 14, a vertical stop wall 16 (more clearly shown in FIG. 4) located between the guiding groove 13 and the narrow groove 14, and a latching groove 17 located in rear of the vertical stop wall 16 and formed on inner walls of the guiding groove 13. Specifically, one part of the latching groove 17 is formed on a lower inner wall 130, and the other part of the latching groove 17 is formed on an upper inner wall (not showing in FIG. 2). In the embodiment, the two guiding grooves 13 extend from two sides of the retaining portion 12 to two sides of the inserting portion 11, and the length of each guiding groove 13 is generally equal to half the length of the case 10. The protrusion 15 is located in the narrow groove 14 and does not protrude out of the narrow groove 14. Moreover, each guiding groove 13 includes a linear groove 131 located in the rear of the guiding groove 13 and a tilted groove 132 located in the front of the guiding groove 13 and tilted inward. Therefore, the depth of the tilted groove 132 is larger than that of the linear groove 131. In the embodiment, the width of the narrow groove 14 is less than the width of the guiding groove 13. The narrow groove 14 is located in front of the tilted groove 132, and the latching groove 17 is communicated with the tilted groove 132.

Referring to FIG. 2, the spring member 20 has an arc section 21 and two supporting feet 22 symmetrically formed on two ends of the arc section 21. In the embodiment, the arc section 21 is generally V-shaped, and the two supporting feet 22 are bent from the two ends of the arc section 21 and extend toward outside. It needs to be noted that the arc section 21 and the two supporting feet 22 are only one of embodiments. Actually, the spring member 20 also may adopt other retaining means for being mounted on the mounting surface 121 of the case 10, and the spring member 20 also may employ only one supporting foot 22 (or a supporting surface) to realize the function of being compressed by the unlocking member 30 and being elastically deformed.

Figure 3:
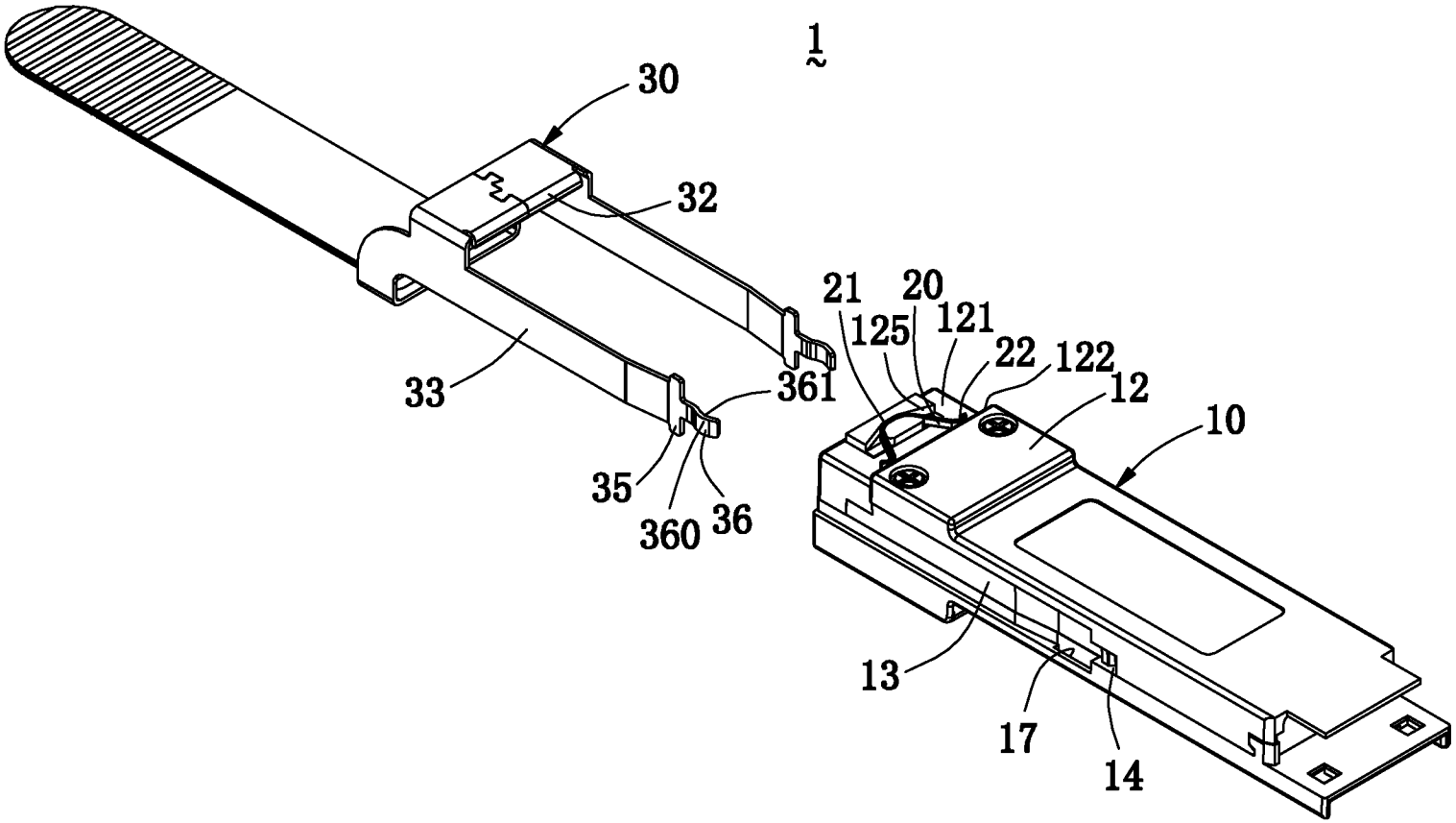
FIG. 3 is an exploded view of the connector with a locking and unlocking mechanism of the present invention, wherein the unlocking member is removed from a case, and the spring member is mounted on the case.
Figure 4:
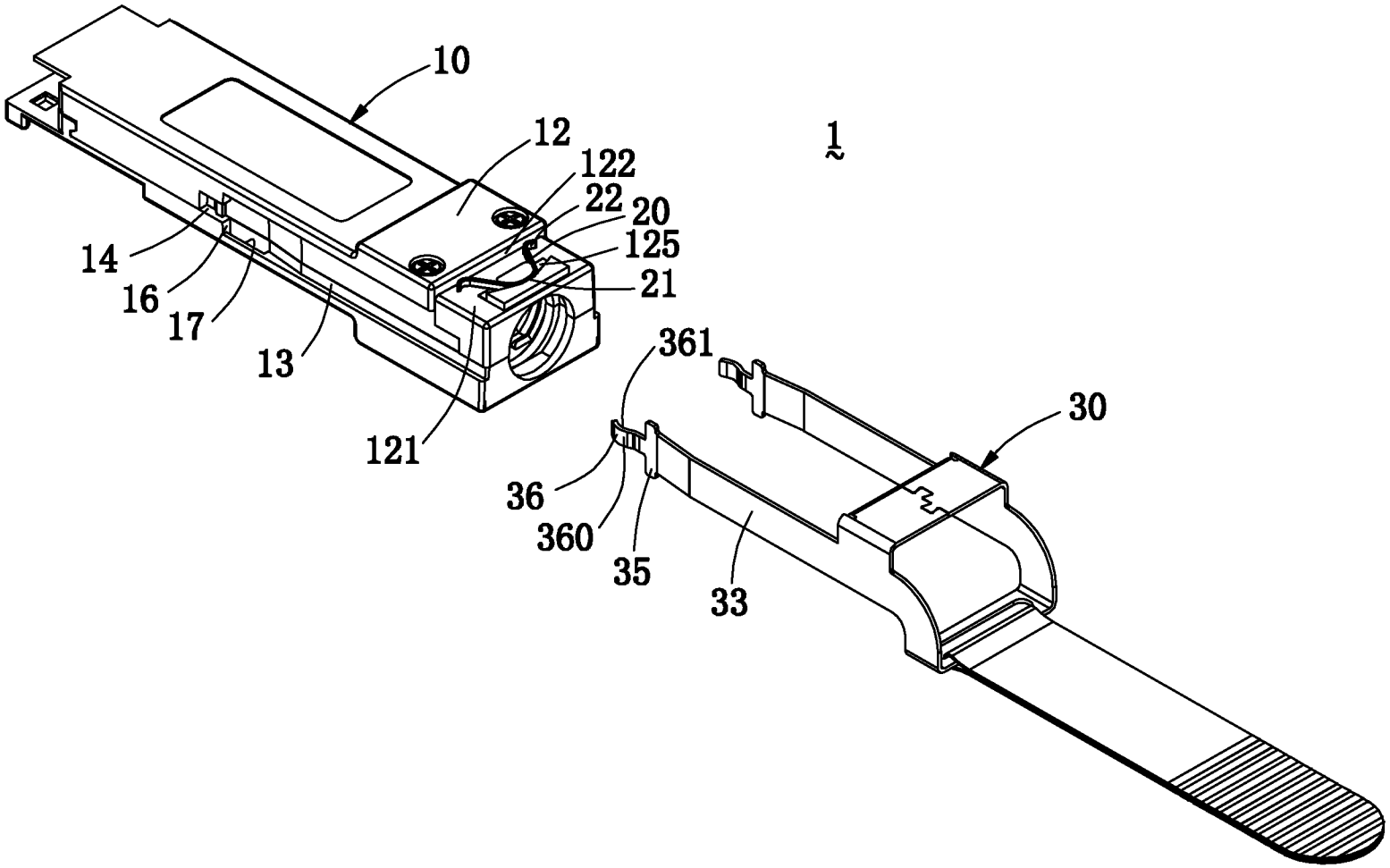
FIG. 4 is another perspective schematic view of the connector of FIG. 3.

Please refer to FIGS. 3 and 4, the spring member 20 is mounted on the retaining portion 12 of the case 10. The arc section 21 is placed in the arc groove 125, and the two supporting feet 22 face the shoulder 122.

Referring to FIG. 2, the unlocking member 30 includes a top wall 31, a vertical portion 32 bent downward from a front side of the top wall 31, two symmetrical guiding arms 33 respectively bent downward from two sides of the top wall 31 and extending forward, and a pulling portion 34 located in rear of the top wall 31 and connected with the two guiding arms 33. The unlocking member 30 further includes a latching plate 35, which is formed on front of each guiding arm 33 and the width of which is larger than that of the guiding arm 33, and a bending end 36, which extends forward from a front edge of the latching plate 35 and the width of which is less than that of the guiding arm 33. The bending end 36 has a convex surface 360 and a concave surface 361. In the embodiment, each guiding arm 33 has a linear arm 330 located in the rear thereof and a tilted arm 331 located in the front thereof and tilted inward. The latching plate 35 and the bending end 36 are formed on a front end of the tilted arm 331. In the embodiment, the pulling portion 34 is a pulling belt.

Figure 1:
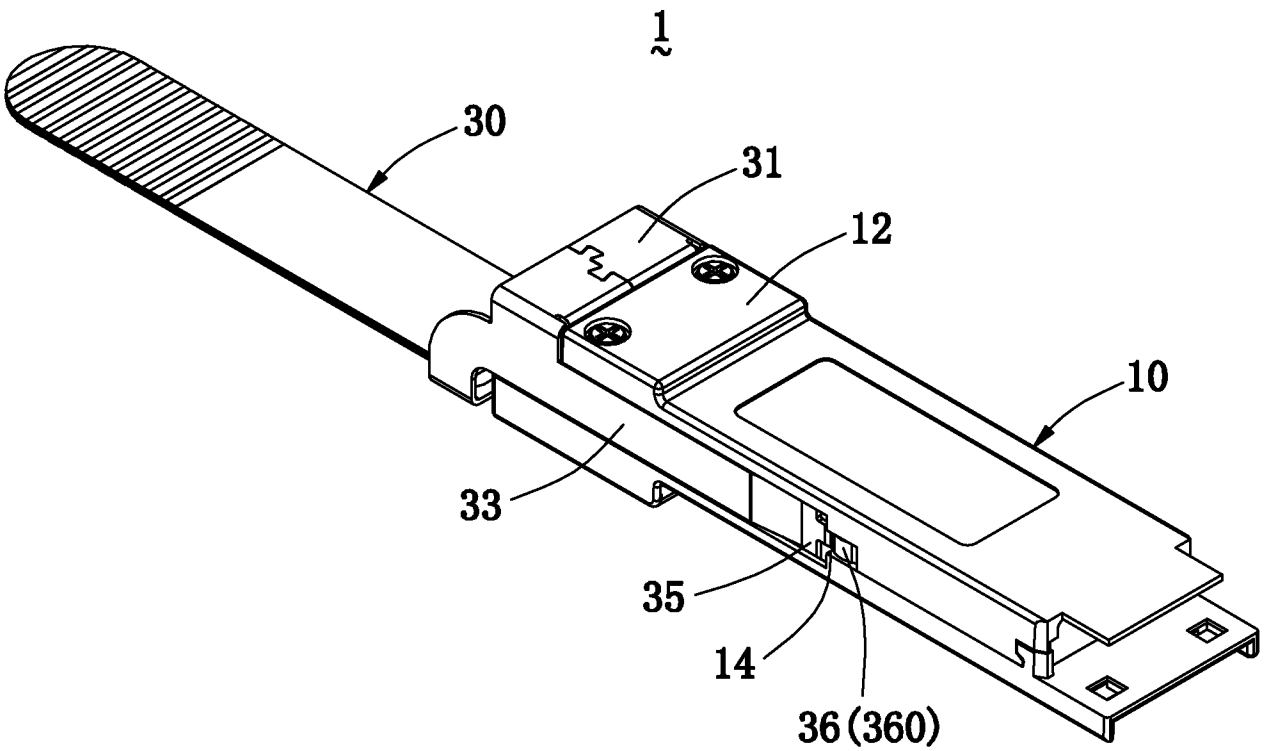
FIG. 1 is a perspective schematic view of a connector with a locking and unlocking mechanism of the present invention.

Please refer to FIGS. 1, 3 and 4, the unlocking member 30 may be mounted on the case 10. The top wall 31 of the unlocking member 30 covers the mounting surface 121 of the retaining portion 12 of the case 10. The vertical portion 32 is inserted between the two supporting feet 22 and the shoulder 122, and the two supporting feet 22 press on the vertical portion 32. Each guiding arm 33 enters into the corresponding guiding groove 13. The latching plate 35 is inserted into the latching groove 17. The bending end 36 enters into the narrow groove 14, the concave surface 361 thereof covers the protrusion 15, and the convex surface 360 is toward outside. In the embodiment, the length of the latching plate 35 is less than that of the latching groove 17. Therefore, when unlocking, the latching plate 35 can slide back and forth within the latching arm 17.

The following text will specifically explain the locking and unlocking principle of the connector 1 of the present invention and the shielding case 9.

Figure 5:
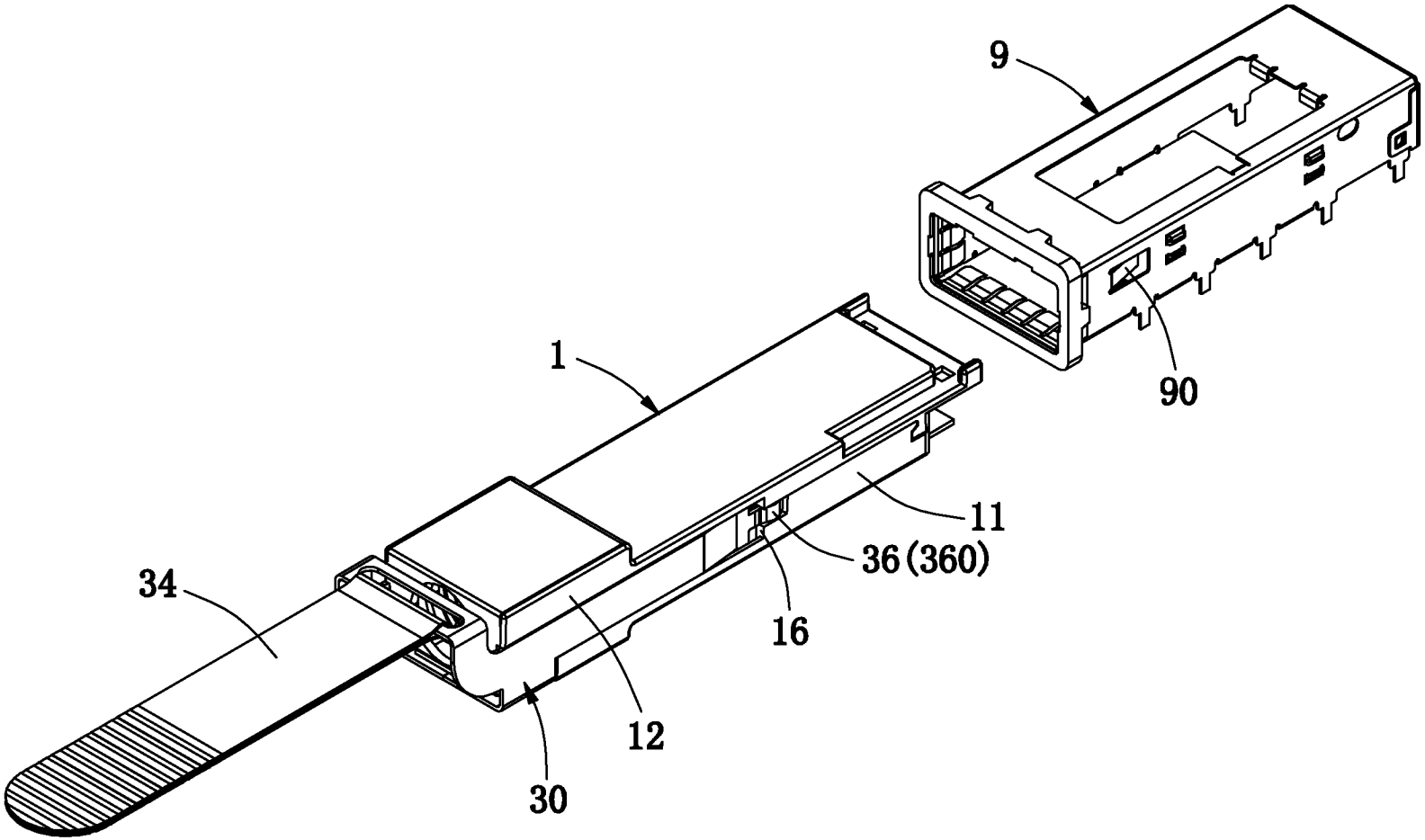
FIG. 5 is a schematic view showing the relationship between the connector and a shielding case.

Please refer to FIGS. 2 and 5, when the inserting portion 11 of the connector 1 is inserted into the shielding case 9, two inner bending portions 90 located two sides of the shielding case 9 respectively enter into the corresponding guiding groove 13 and lean on the vertical stop wall 16 to prevent the connector 1 from leaving the shielding case 9. When unlocking, the pulling portion 34 of the unlocking member 30 may be pulled backward by an external force, the bending end 36 covering the protrusion 15 will be moved backward, and the convex surface 360 of the bending end 36 will smoothly push the inner bending portion 90 outward. When the inner bending portion 90 is completely pushed away and leaves the vertical stop wall 16, the connected 1 can be smoothly pulled out of the shielding case 9. Furthermore, during unlocking, when the pulling portion 34 of the unlocking member 30 is pulled backward, the vertical portion 32 will be moved backward and force the two supporting feet 22 of the spring member 20 to be gradually opened. Now, the spring member 20 is elastically deformed. After unlocking, the external force is canceled, the unlocking member 30 will be moved forward under the elastic effect of the spring member 20 and be restored to the initial state.

In conclusion, the connector 1 of the present invention can be efficiently locked in the shielding case 9 by disposing the vertical stop wall 16 on the case 10, can be efficiently unlocked by the bending end 36 of the unlocking member 30, and can be restored to the initial state under the function of the spring member 20. It can be seen that the locking and unlocking way of the connector 1 is very convenient and fast.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector with a locking and unlocking mechanism, comprising:

a case including an inserting portion located in the front thereof, a retaining portion located in the rear thereof, and two guiding grooves being symmetrically formed two opposite sides of the case; the retaining portion including a top surface, a mounting surface lower than the top surface, and a shoulder connecting the mounting surface and the top surface; the case further including a narrow groove, which is located in front of each guiding groove and the width of which is less than that of the guiding groove, a protrusion located in the narrow groove, a vertical stop wall located between the guiding groove and the narrow groove, and a latching groove located in rear of the vertical stop wall;

a spring member being mounted on the mounting surface and having at least one supporting foot facing the shoulder; and an unlocking member including a top wall, a vertical portion bent downward from a front side of the top wall, two symmetrical guiding arms respectively bent downward from two sides of the top wall and extending forward, and a pulling portion located in rear of the top wall; the unlocking member further including a latching plate, which is formed in front of each of the two guiding arms and the width of which is larger than that of the guiding arm, and a bending end, which extends forward from a front edge of the latching plate and the width of which is less than that of the guiding arm;

wherein the top wall of the unlocking member covers the mounting surface, the vertical portion being inserted between the supporting foot and the shoulder, the supporting foot pressing on the vertical portion, the guiding arm extending into the corresponding guiding groove, the latching plate entering into the latching groove, the bending end entering into the narrow groove and covering the protrusion, the length of the latching plate being less than that of the latching groove; when pulling the pulling portion backward, the vertical portion being moved backward and compressing the spring member, the guiding arm being moved backward along the guiding groove, the latching plate sliding backward along the latching groove, and the bending end being moved backward along the protrusion.

2. The connector with a locking and unlocking mechanism as claimed in claim 1, wherein the case further includes a front block formed on the mounting face, a rear block formed on the mounting surface and an arc groove located between the front block and the rear block.

3. The connector with a locking and unlocking mechanism as claimed in claim 2, wherein the spring member has an arc section and two supporting feet, the arc section is mounted in the arc groove, and the two supporting feet are symmetrically formed on two ends of the arc section and extend out of the arc groove.

4. The connector with a locking and unlocking mechanism as claimed in claim 3, wherein the arc groove is V-shaped, two ends of the arc groove are extending toward the shoulder, and the width of each end of the arc groove is larger than the width of the middle of the arc groove; the arc section is V-shaped, and the two supporting feet are respectively bent from the two ends of the arc section and extend outward.

5. The connector with a locking and unlocking mechanism as claimed in claim 1, wherein the latching groove is formed on inner walls of the guiding groove and is communicated with the guiding groove, and the latching plate is inserted into the latching groove.

6. The connector with a locking and unlocking mechanism as claimed in claim 5, wherein each guiding groove includes a linear groove located in the rear of the guiding groove and a tilted groove located in the front of the guiding groove and tilted inward, the depth of the tilted groove is larger than that of the linear groove, the narrow groove is located in front of the tilted groove, and the latching groove is communicated with the tilted groove.

7. The connector with a locking and unlocking mechanism as claimed in claim 6, wherein each guiding arm has a linear arm located in the rear thereof and a tilted arm located in the front thereof and tilted inward, and the latching plate and the bending end are formed on a front end of the tilted arm.

8. The connector with a locking and unlocking mechanism as claimed in claim 1, wherein the bending end has a convex surface covering the protrusion and a concave surface being toward outside.

9. The connector with a locking and unlocking mechanism as claimed in claim 1, wherein the pulling portion is a pulling belt.

10. The connector with a locking and unlocking mechanism as claimed in claim 1, wherein the top surface of the retaining portion is higher than a top surface of the inserting portion, and the mounting surface and the top surface of the retaining portion are parallel each other.

* * * * *